United States Patent [19]

Burmeister et al.

[11] 4,091,788

[45] May 30, 1978

[54] STARTER MECHANISM WITH OVERSPIN RESTRICTOR SHOE

[75] Inventors: Dennis N. Burmeister, Libertyville; Adolph J. Yourich, Waukegan, both of Ill.

[73] Assignee: Outboard Marine Corporation, Waukegan, Ill.

[21] Appl. No.: 658,592

[22] Filed: Feb. 17, 1976

[51] Int. Cl.[2] ..... F02N 1/00

[52] U.S. Cl. ..... 123/185 BA; 185/45

[58] Field of Search ..... 123/185 BA; 267/156, 267/157; 185/37, 43, 45

[56] References Cited

U.S. PATENT DOCUMENTS

| | | | |
|---|---|---|---|
| 1,298,716 | 4/1919 | Hoover | 185/45 |
| 1,353,106 | 9/1920 | Wicoff | 185/43 |
| 1,495,348 | 5/1924 | Odom | 185/43 |
| 2,243,780 | 5/1941 | Thigpen | 185/45 |
| 2,480,550 | 8/1949 | Catlin | 123/185 BA |
| 2,592,639 | 4/1952 | Armstrong | 123/185 BA |
| 2,597,334 | 5/1952 | Johnson et al. | 123/185 BA |
| 2,617,248 | 11/1952 | Brown | 185/43 |

*Primary Examiner*—Charles J. Myhre

*Assistant Examiner*—David D. Reynolds

*Attorney, Agent, or Firm*—Michael, Best & Friedrich

[57] ABSTRACT

Disclosed herein is a starter mechanism comprising a member adapted to be fixed relative to an engine, a pulley which includes a side face and a peripheral groove and which is mounted for rotation with respect to the housing member and with the side face in spaced, generally parallel relation to the member so as to define a spring chamber, a coiled rewind spring located in the chamber and having a plurality of convolutions intermediate inner and outer ends which are respectively anchored to the pulley and to the member, a pull rope anchored to the pulley and wound in the groove, whereby withdrawal of the pull rope from the pulley causes rotation of the pulley in the direction which is effective to wind up the rewind spring and whereby, subsequent to withdrawal of the rope from the pulley and upon release of the pull rope, the rewind spring serves to rotate the pulley in the opposite direction so as to rewind the pull rope in the groove and to unwind the spring, and a restrictor shoe mounted on the pulley for preventing overrunning of the pulley in the rewind direction.

5 Claims, 3 Drawing Figures

Fig. 1
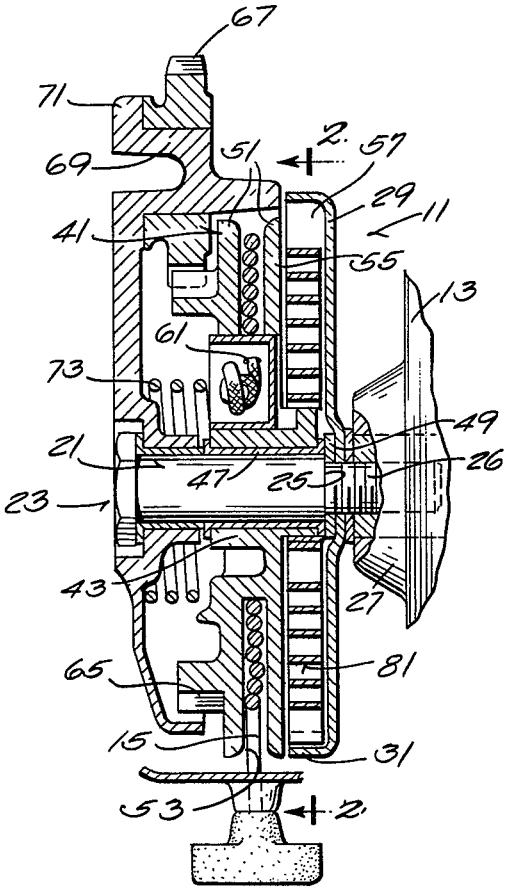
Fig. 2
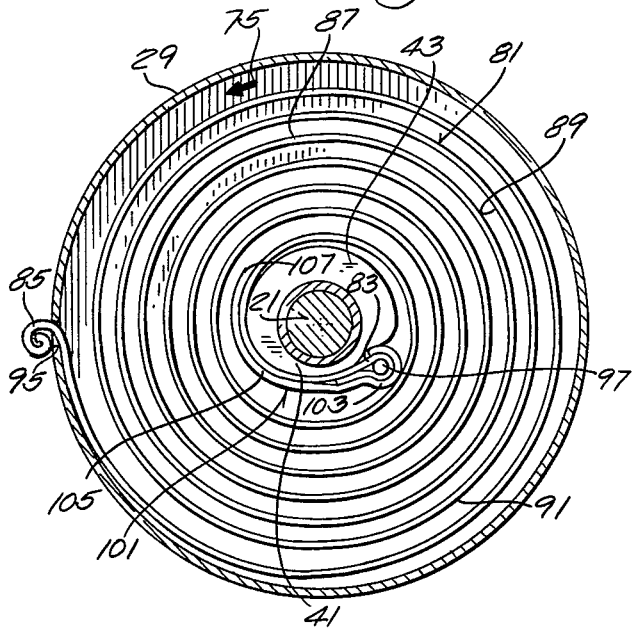
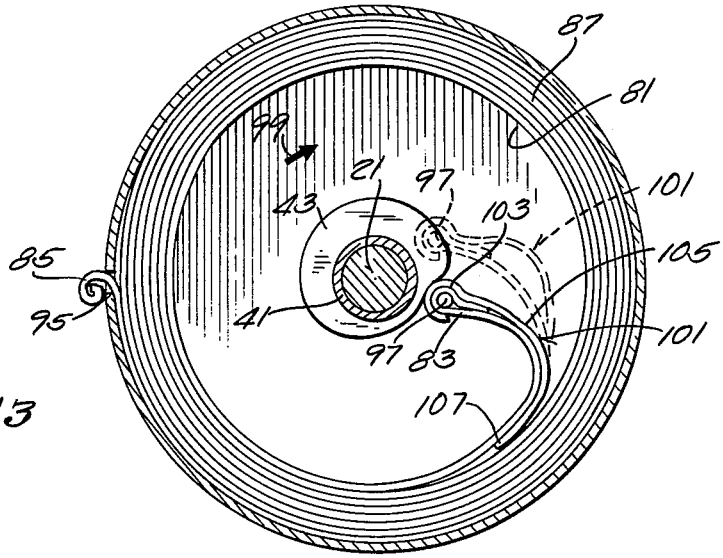
Fig. 3

STARTER MECHANISM WITH OVERSPIN RESTRICTOR SHOE

BACKGROUND OF THE INVENTION

The invention relates generally to starter mechanisms for internal combustion engines. More particularly, the invention relates to pull rope operated starter mechanisms. Still more particularly, the invention relates to pull rope starter mechanisms with a rewind spring for automatically rewinding the pull rope to condition the starter for subsequent usage.

In the past, when the pull rope broke during starter operation or was suddenly released by the operator after withdrawal from the pulley, the rewind spring sometimes caused excessive pulley rewinding movement which caused the spring to be damagingly bent or creased so as to require replacement of the rewind spring. The invention disclosed herein prevents such overrunning or excessive rewind rotary movement of the pulley carrying the pull rope.

SUMMARY OF THE INVENTION

The invention provides a starter mechanism comprising a housing member adapted to be fixed relative to an engine, a pulley which includes a side face and a peripheral groove and which is mounted for rotation with respect to the housing member and with the side face in spaced, generally parallel relation to the housing member so as to define a spring chamber, a coiled rewind spring located in the chamber and having a plurality of convolutions intermediate inner and outer ends, means anchoring the outer end of the rewind spring in fixed relation to the housing member, means anchoring the inner end of the rewind spring to the pulley for common rotation of the inner end of the spring with the pulley, a pull rope anchored to the pulley and wound in the groove, whereby withdrawal of the pull rope from the pulley causes rotation of the pulley in the direction which is effective to wind up the spring and whereby, subsequent to withdrawal of the pull rope from the pulley and upon release of the pull rope, the spring serves to rotate the pulley in the opposite direction so as to rewind the pull rope in the groove and to unwind the spring, and means mounted on the pulley for preventing overrunning of the pulley in the rewind direction.

In accordance with an embodiment of the invention, the rewind spring has an inside surface, the means for preventing overrunning of the pulley in the rewind direction comprises a control member or shoe mounted on the pulley for common rotation therewith and for movement relative thereto and into engagement with the inside surface of the outwardly adjacent one of the convolutions of the rewind spring.

In accordance with an embodiment of the invention, the rewind spring has an inside surface, the means anchoring the inner end of the rewind spring comprises a pin extending rigidly from the pulley into the chamber and the inner end of the spring is formed into a loop received on the pin, and the means for preventing overrunning of the pulley in the rewind direction comprises a control member or shoe including a loop portion pivotally mounted on the pin in outward relation to the inner end of the rewind spring and an extending portion pivotally movable between a radially inwardly located retracted position and a radially outwardly located extended position in which the extending portion engages the inside surface of the outwardly adjacent one of the convolutions to engage the convolutions against one another and against the housing member so as thereby to prevent overrunning of the pulley in the rewind direction.

In accordance with an embodiment of the invention, the rewind spring has an outside surface, the extending portion of the control member or shoe is generally arcuate in shape and is adapted to be engaged by the outside surface of the rewind spring adjacent to the inner end so as to displace the control member to the radially extended position in response to attempted overrunning of the pulley in the rewind direction.

One of the principal features of the invention is provision of a starter mechanism including means on the pulley for preventing overrunning or excessive rotary movement of the pulley in the rewind position.

Another of the principal features of the invention is the provision of a starter mechanism which is relatively simple and economical to construct and which includes means on the pulley for preventing overrunning or excessive rotary movement of the pulley in the rewind direction.

Another principal feature of the invention is the provision of a starter mechanism which includes means on the pulley for preventing such excessive rotary movement of the pulley in the rewind direction as could damage the rewind spring.

Other features and advantages of the embodiments of the invention will become known by reference to the following description, claims and appended drawings.

THE DRAWINGS

FIG. 1 is a sectional view of a starter mechanism incorporating various of the features of the invention.

FIG. 2 is a view taken along line 2—2 of FIG. 1 illustrating the components of a starter mechanism with the rewind spring in a tensioned or cocked position.

FIG. 3 is a view similar to FIG. 2 showing the rewind spring and the restrictor shoe operating to prevent overrunning in the rewind direction.

Before explaining one embodiment of the invention in detail, it is to be understood that the invention is not limited in its application to the details of construction and the arrangement of the components set forth in the following description or illustrated in the drawings. The invention is capable of other embodiments and of being practiced and carried out in other various ways. Also, it is to be understood that the phraseology and terminology employed herein is for the purpose of description and should not be regarded as limiting.

GENERAL DESCRIPTION

Shown in the drawings is an engine starter mechanism 11 which is adapted to be mounted on an engine 13 which is shown fragmentarily and which includes a starter gear (not shown) adapted to be operated so as to start the engine. More particularly, the starter mechanism 11 is of the type which is operative, upon withdrawal of a pull rope 15, to cause rotation of the starter gear so as to initiate engine operation.

While various starter constructions can be employed, in the illustrated construction, the starter mechanism 11 includes a central stud 21 which includes an outer head 23, a shoulder 25 spaced from the outer head 23, and an inner portion 26 adapted to be threadably connected to a boss 27 on the engine 13. Fixed between the shoulder 25 and the boss 27 is a cup or housing member 29 which is fixed relative to the engine 13 and which includes a circular flange 31.

Rotatably carried on the central stud 21 is a pulley 41 including a central hub 43 having a portion which projects axially toward the housing member 29 and which is seated against a combined radial and thrust bearing 47 engaging a washer 49 in abuting relation to the housing member 29.

The pulley 41 also includes a pair of spaced pulley halves 51 which define a peripheral groove 53 adapted to receive several coils of the pull rope 15.

One of the pulley halves 51 includes a side face 55 which is located in spaced opposing relation to the housing member 29 so as to define therebetween a spring chamber 57.

The pulley 41 also includes a pocket 61 into which the enlarged inner end of the pull rope 15 can be located so as to anchor the inner end of the pull rope 15 adjacent the radially inner part of the peripheral groove 53.

In addition, the pulley 41 has fixed thereon a ring gear 65 which is in mesh with a pinion 67 rotably mounted on a part 69 of an arm 71 which, in turn, is rotably mounted on the central stud 21 between the head end 23 and the pulley 41.

Located between the pulley 41 and the arm 71 is a spring 73 which urges the hub 43 of the pulley 41 axially against the bushing 47 and which biases the arm 71 away from the pulley 41 and toward the outer head 23 so as to releasably cause common rotary movement of the arm 71 with the pulley 41.

Means (not shown) are provided for limiting rotary travel of the arm 71 about the stud 21 between a position wherein the pinion 67 is engaged with the engine starter gear (not shown) and an angularly spaced position clear of the engine starter gear.

Assuming the pull rope 15 to be wound in the groove 53, withdrawal of the pull rope 15 by the operator causes pulley rotation in the counter clockwise direction as shown by the arrow 75 shown in FIG. 2 so as to initially swing the arm 71 into position for engagement of the pinion 67 with the starter gear and thereafter to rotate the pinion 67 on the arm 71 while engaged with the starter gear so as to turn over the engine crankshaft and thereby initiate engine operation.

In order to return or rewind the pull rope 15 into the pulley groove 53 so as to facilitate a subsequent starting operation, the starter mechanism 11 also includes a coiled rewind spring 81 which (See FIGS. 2 and 3) has inner and outer ends 83 and 85, respectively, and intermediate thereof, a plurality of convolutions 87. In addition, the rewind spring 81 includes inside and outside surfaces 89 and 91 respectively.

In order to prevent rotation of the rewind spring 81 the outer end 85 thereof is fixed relative to the housing member 29. Various means can be employed to anchor or fix the outer end 85 of the rewind spring 81 against rotation. In the illustrated construction, the circular flange 31 of the housing member 29 includes a slot 95 and the rewind spring 81 extends through the slot 95 with the spring outer end 85 being bent or curled upon itself to prevent withdrawal of the spring outer end 85 through the slot 95 into the spring chamber 58 and thereby also to anchor the spring outer end 85 against rotation.

Means are also provided for connecting the inner end 83 of the rewind spring 81 to the pulley 41 for common rotation therewith. While various arrangements can be employed, in the illustrated construction, there is provided a pin 97 which extends fixedly from the pulley 41 into the spring chamber 57. In addition, the inner end 83 of the rewind spring 81 is formed into a loop which is received over the pin 97 so as to permit relative pivotal movement between the spring inner end 83 and the pin 97 while also affording common rotary movement of the spring inner end 83 and the pulley 41.

Accordingly, when the pull rope 15 is withdrawn from the groove 53 to initiate engine starting operation, the pulley 41 rotates in the counter clockwise direction as seen in FIG. 2 so as to wind up the rewind spring, i.e., to tighten or contract the coil spring convolutions 87 and thereby to store energy therein. When the pull rope 15 is released, the stored energy in the rewind spring 81 serves to rotate the pulley 41 in the opposite or clockwise direction, as shown by the arrow 99 in FIG. 3, so as to rewind the pull rope 15 into the pulley 41. During such rewinding operation, the convolutions 87 of the rewind spring 81 expand.

Means are provided for preventing overrunning or excessive rewind rotary movement of the pulley 41, as can occur, for instance, if the pulley rope is severed or cut. Under such circumstances, the rotary movement of the pulley can carry the inner end of the spring to a position which would damage the rewind spring by creasing, bending or buckling the rewind spring. Such overrunning action is prevented by means of a brake, restrictor shoe or control member 101 which is formed, at one end, with a loop portion 103 permitting mounting of the control member 101 on the pin 97 and over the looped spring inner end 83. The control member 101 also includes an extending portion 105 which is generally semi-circularly shaped, and which terminates in a short straight outer or free end portion 107.

The control member 101 is designed so that the curved extending portion 105 will nest, as shown in FIG. 2, with about one-half of the innermost convolution of the rewind spring 81 in adjacent relation to the outer peripheral surface of the projecting portion 45 of the pulley hub 43 when the rewind spring is wound up as shown in FIG. 2. However, the control member 101 can swing outwardly so as to engage the outer end portion 107 against the side surface 89 of the outwardly adjacent convolution 87, as shown in full lines in FIG. 3, so as to press the convolutions 87 against one another and against the outer circular flange 31 of the housing member 29 and thereby also to brake or stop rotary movement of the pulley 41 in the rewind direction before occurrence of such overrunning as could cause damaging buckling, or creasing, or bending of the rewind spring 81.

The control member or restrictor shoe 101 is forced outwardly to the braking position against the inside surface 83 of the outwardly adjacent convolution 87 by action of the rewind spring 81. In this regard, rotation of the pin 101 beyond the point where the rewind spring 81 is fully relaxed (as shown in dotted outline in FIG. 3) will cause the portion of the spring adjacent to the inner end 83 to begin to form a 180° loop. Engagement of the outside surface 91 of the forming loop with the inner surface of the arcuately extending portion 105 of the control member 101 causes pivoting of the control member or restrictor 101 outwardly to the braking position, thereby preventing such overrunning of the pulley 41 as could cause damaging creasing, buckling or bending of the spring consequent to excessive looping of the spring due to overrunning of the pulley 41 in the rewind direction.

Various of the features of the invention are set forth in the following claims.

What is claimed is:

1. A starter mechanism comprising a housing member adapted to be fixed relative to an engine, a pulley having a side face and a peripheral groove, means mounting said pulley for rotation with respect to said housing member and with said side face in spaced generally parallel relation to said housing member so as to define a spring chamber, a coiled rewind spring located in said chamber, said spring having a plurality of convolutions, an inner end, and an outer end, means anchoring said outer end of said spring in fixed relation to said housing member, means anchoring said inner end of said spring to said pulley for common rotation of said inner end of said spring with said pulley at all times, a pull rope anchored to said pulley and wound in said groove, whereby withdrawal of said pull rope from said pulley causes rotation of said pulley in the direction which is effective to wind up said rewind spring and whereby, subsequent to withdrawal of said pull rope from said pulley and upon release of said pull rope, said spring serves to rotate said pulley in the opposite direction so as to rewind said pull rope in said groove and to unwind said rewind spring, and means mounted on said pulley for preventing overrunning of said pulley in the rewind direction.

2. A starter mechanism comprising a housing member adapted to be fixed relative to an engine, a pulley having a side face and a peripheral groove, means mounting said pulley for rotation with respect to said housing member and with said side face in spaced generally parallel relation to said housing member so as to define a spring chamber, a coiled rewind spring located in said chamber, said spring having a plurality of convolutions, an inner end, an outer end, and an inside surface, means anchoring said outer end of said spring in fixed relation to said housing member, means anchoring said inner end of said spring to said pulley for common rotation of said inner end of said spring with said pulley, a pull rope anchored to said pulley and wound in said groove, whereby withdrawal of said pull rope from said pulley causes rotation of said pulley in the direction which is effective to wind up said rewind spring and whereby, subsequent to withdrawal of said pull rope from said pulley and upon release of said pull rope, said spring serves to rotate said pulley in the opposite direction so as to rewind said pull rope in said groove and to unwind said rewind spring, and means mounted on said pulley for preventing overrunning of said pulley in the rewind direction, said means for preventing overrunning of said pulley in the rewind direction comprising a control member mounted on said pulley for common rotation therewith and for movement relative thereto and into engagement with the inside surface of the outwardly adjacent one of said convolutions of said rewind spring.

3. A starter mechanism comprising a housing member adapted to be fixed relative to an engine, a pulley having a side face and a peripheral groove, means mounting said pulley for rotation with respect to said housing member and with said side face in spaced generally parallel relation to said housing member so as to define a spring chamber, a coiled rewind spring located in said chamber, said spring having a plurality of convolutions, an inner end formed into a loop, an outer end, and an inside surface, means anchoring said outer end of said spring in fixed relation to said housing member, means anchoring said inner end of said spring to said pulley for common rotation of said inner end of said spring with said pulley, said means anchoring said inner end of said rewind spring comprising a pin extending rigidly from said pulley into said chamber and received in said loop, a pull rope anchored to said pulley and wound in said groove, whereby withdrawal of said pull rope from said pulley causes rotation of said pulley in the direction which is effective to wind up said rewind spring and whereby, subsequent to withdrawal of said pull rope from said pulley and upon release of said pull rope, said spring serves to rotate said pulley in the opposite direction so as to rewind said pull rope in said groove and to unwind said rewind spring, and means mounted on said pulley for preventing overrunning of said pulley in the rewind direction, said means for preventing overrunning of said pulley in the rewind direction comprising a control member including a loop portion pivotally mounted on said pin in outward relation to said inner end of said rewind spring and an extending portion pivotally movable between a radially inwardly located retracted position, and a radially outwardly located extended position in which said extending portion engages said inside surface of the outwardly adjacent one of said convolutions to engage said convolutions against one another and against said housing member so as thereby to prevent overrunning of said pulley in the rewind direction.

4. A starter mechanism in accordance with claim 3 wherein said spring has an outside surface, wherein said control member extending portion is generally arcuate in shape and is adapted to be engaged by the outside surface of said rewind spring adjacent to said inner end so as to displace said control member to the radially extended position in response to attempted overrunning of said pulley in the rewind direction.

5. A starter mechanism comprising a housing member adapted to be fixed relative to an engine, a pulley having a side face and a peripheral groove, means mounting said pulley for rotation with respect to said housing member and with said side face in spaced generally parallel relation to said housing member so as to define a spring chamber, a coiled rewind spring located in said chamber, said spring having an inner end, and an outer end, means anchoring one of said ends of said spring in fixed relation to said housing member, means anchoring the other of said ends of said spring to said pulley for common rotation thereof with said pulley, a pull rope anchored to said pulley and wound in said groove, whereby withdrawal of said pull rope from said pulley causes rotation of said pulley in the direction which is effective to wind up said rewind spring and whereby, subsequent to withdrawal of said pull rope from said pulley and upon release of said pull rope, said spring serves to rotate said pulley in the opposite direction so as to rewind said pull rope in said groove and to unwind said rewind spring, and means for preventing overrunning of said pulley in the rewind direction including a member mounted on said pulley for common rotation therewith and for movement relative to said pulley so as to prevent pulley overrunning.

* * * * *